United States Patent [19]

Devereaux

[11] 4,132,987

[45] Jan. 2, 1979

[54] SECURITY SYSTEM

[76] Inventor: Richard A. Devereaux, 112 Wolcott Ave., West Springfield, Mass. 01089

[21] Appl. No.: 845,635

[22] Filed: Oct. 26, 1977

[51] Int. Cl.[2] ..... G08B 13/00

[52] U.S. Cl. ..... 340/506; 340/533; 340/568

[58] Field of Search ..... 340/506, 531, 533, 541, 340/561, 568, 551

[56] References Cited

U.S. PATENT DOCUMENTS 3,938,124 2/1976 Way et al. ..... 340/531

*Primary Examiner*—Alvin H. Waring

*Attorney, Agent, or Firm*—Ross, Ross & Flavin

[57] ABSTRACT

A security system of the type including one or more electrically-continuous closed loops for detecting the presence of an intruder wherein a breach in security indicative of the intrusion is sensed by a change in potential at a point along the line with which the closed loop is electrically connected.

3 Claims, 4 Drawing Figures

SECURITY SYSTEM

My invention relates to protection systems and more particularly to such systems wherein a protection circuit at a protected area is connected to a supervisory circuit at a central station having signal responsive devices associated therewith for the purpose of detecting an occurrence at the protected area.

Protection systems are customarily responsive to signals which may be represented by an increase or decrease in direct current above or below a predetermined current range. Relays or other detecting devices are controlled by these current changes and effect the operation of various signalling devices located in an alarm circuit at the central station.

Heretofore, particularly in the case of a burglar alarm system, it has been possible for an intruder to defeat the purpose of the system by tampering with the circuit at the protected area. Thus, for example, by bridging the transmission lines at the protected area with a device that approximates the electrical resistance of the protection circuit, an entry could be effected without causing operation of the detecting devices located at the central station. Additionally, it has occasionally been the practice of intruders to accomplish such tampering while the protection system was in its protection-off condition in preparation for a night entry, and thus, when the protection circuit is connected to the line to provide protection-on service, no signal is received at the central station and the signalling devices located therein remain quiescent during a subsequent intrusion.

One general object of this invention, therefore, is to provide an improved protection system of the type wherein a protection circuit at a protected area is connected to a supervisory circuit at a central station.

More specifically, it is an object of this invention to provide such a system wherein the possibility of undetected tampering is substantially minimized.

Still another object of the invention is to provide a new and improved protection system utilizing comparatively simple electrical components which is economical to manufacture and thoroughly reliable in operation.

The invention relates more particularly to electrical conductors of the type used in cables where the conductor comprises a plurality of conducting elements. Conductors of the type used in cables for the transmission of electromagnetic energy comprise, in general, a central core member of conducting material surrounded by an encapsulating wire of conducting material which extends longitudinally of the core, which wires are insulated from each other so that each contributes materially to the conduction of current.

Transposition is the forming of a conductor with a number of conducting elements connected in parallel and shifting same as to each other so that each conductor receives its share of exposure to a main field. Such is used, especially in conductors of high frequencies so that the alternating-current resistance may be minimized, the technique amounting to forcing the current to distribute itself over the entire cross sectional area of the composite of individual conducting elements, thereby increasing the total current carrying area. In other words, in a conductor, at intervals along the length thereof, the inner conductor becomes the outer conductor and the outer conductor becomes the inner conductor.

In a strict sense, transposition is involved in this invention but with a slightly different technique and for a vastly different purpose.

Communication cables which provide means for the detection of interference therewith, by way of any unauthorized or by-pass or shunt, are necessary in many communications applications.

While many cables of this type are known in the art, none offers the requisite security against intruders through tapping.

Most of those cables known to the art prevent direct entry into the cable core as, for example, by a probe. However in these cables, it is relatively easy to strip or peel back the outer jacketing covering, alarm wires or tapes, to bridge a part of such wires or tapes and, after bridging the alarm wires or tapes, to cut into the cable. The bridged alarm wires or tapes are electrically bypassed and thus do not trigger the alarm circuits.

It is, therefore, one primary object of this invention to provide a security cable construction offering a high degree of resistance to tapping of the cable.

As one feature of the invention, in a preferred embodiment, an electrically-continuous loop is provided which is comprised essentially of two main components, a first part consisting of a conductor cable inclusive of a core wire of positive charge and a shield wire of negative charge and interconnected by suitable separable jack arrangement with a second part consisting of a conductor cable inclusive of a core wire of negative charge and a shield wire of positive charge, the two cables sharing a common lead to a connecting plug for connection first to an energy source and second to an alarm adequate for signalling the fact of unwarranted intrusion in the line by the breaking of the loop through the separation of the mating jack parts or by any attempt to successfully bridge the jack arrangement so as to allow subsequent separation of the mating jack parts without causing operation of the detecting devices or signals.

In this particular embodiment, a basic security cable unit comprises a looped or lasso type of arrangement incorporating a pair of conductor cables, each including a cable core or inner wire having an inner insulating jacket extended thereover and an outer wire disposed over the inner wire and jacket in circumscribing manner, the latter in turn being itself covered by an outer insulating cover. The two cables cooperantly form a complete loop with a suitable connecticut plug being fixed to the cables at one end of each. At the other end of each, the conductor cables are provided, one with the male component of a separable and interconnectible phone jack connector which may be interfitted in known manner so as to effect a closing of a loop when the phone jack is in non-separated mode.

The key to the invention lies in the fact that the closed loop is offered a unique normally non-detectable characteristic. The male element of the jack connection may be connected to the conductor having the positive charge on the inner core and the negative charge on the outer shield or braid wire, whereas the female element of the jack connection may be connected to the conductor having the positive charge on the shield wire and the negative charge on the core wire, wherefore a form of transposition is attained.

By such transposition, the current will be understood to follow out away from the connecting plug along one wire and through the male/female phone jack connector and to follow in returnably to the conductor plug along the other wire all to the end that easy by-pass or shunt is made difficult, the would-be intruder being unaware of the transposition. Any effort to shunt from one shield wire to the other shield wire will result in the ready assumption of the alarm mode.

Such looped arrangements can be set up so as to enclose any area or item being protected, such as a house, office, factory, store, auto park, or trailer or freight car, the connector plug being connected of course to an energy source and to an alarm or being connected as an appendage to another closed circuit alarm system or plurality thereof, all as may be desired.

The burglar or other unwanted type, in his effort to by-pass or shunt the cable, would be expected to attempt to interconnect the shield wire on one side of the loop or lasso with the shield wire on the other side of the loop, or the core wire of one with the core wire of the other in order to allow his separation of the male/-female phone jack connection so as then to allow himself the necessary separation of the two lasso parts in order that he might have undetected access to the installation or article being secured.

With the wires so constructed, especially with the outermost wire being of braided type, ready access to the innermost wire is rendered exceedingly different, but even more importantly, when if only positive-negative connection is made (that is, for example, a connection between a positive shield wire on one side of the loop and a negative shield wire on the other side of the loop), the system is shorted, resulting in an alarm signal mode.

As another feature of the invention, a molded distributor ring may be provided which incorporates a plurality of female conductor plugs, which plugs may be each of say the four conductor type and may be series connected with and within the distributor ring, and a plurality of accommodating male conductors, also of say the four conductor type, each being operationally mated with one of the female conductor plugs, lead being provided from the distributor ring to a suitable switch means and thence to the signal or alarm mechanism. In this way, a plurality of individual loops may be brought together from distant places or areas to a central distributing point, i.e. the ring, for series interconnection wherefore all of the loop systems are tied into each other in manner such that an interruption at any point along any individual loop results in a signalling of the intrusion.

Having briefly described this invention, it will be described in greater detail thereof in the following detailed description which may best be understood by reference to the accompanying drawings, of which:

Figure 4:
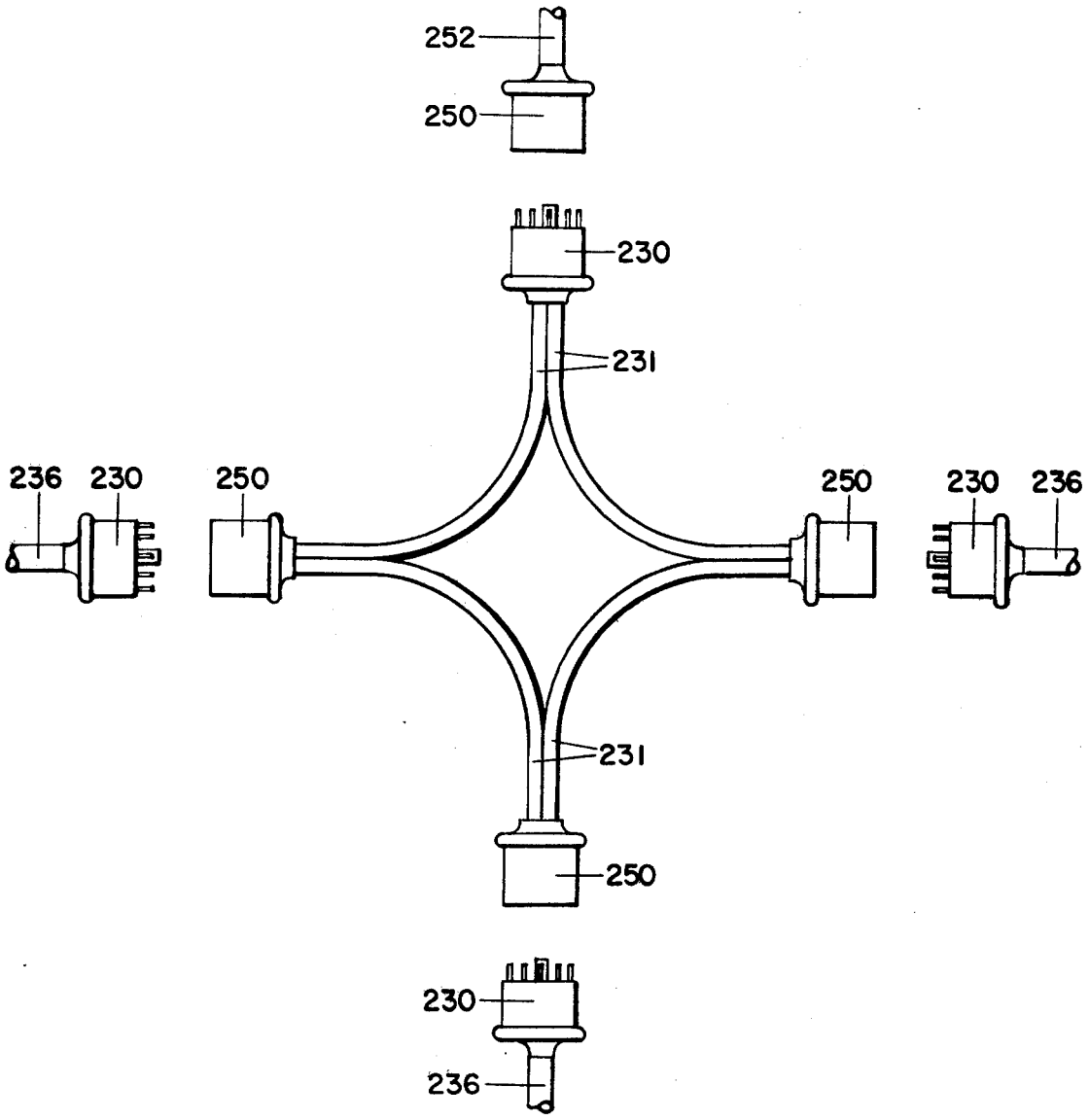
Figure 3:
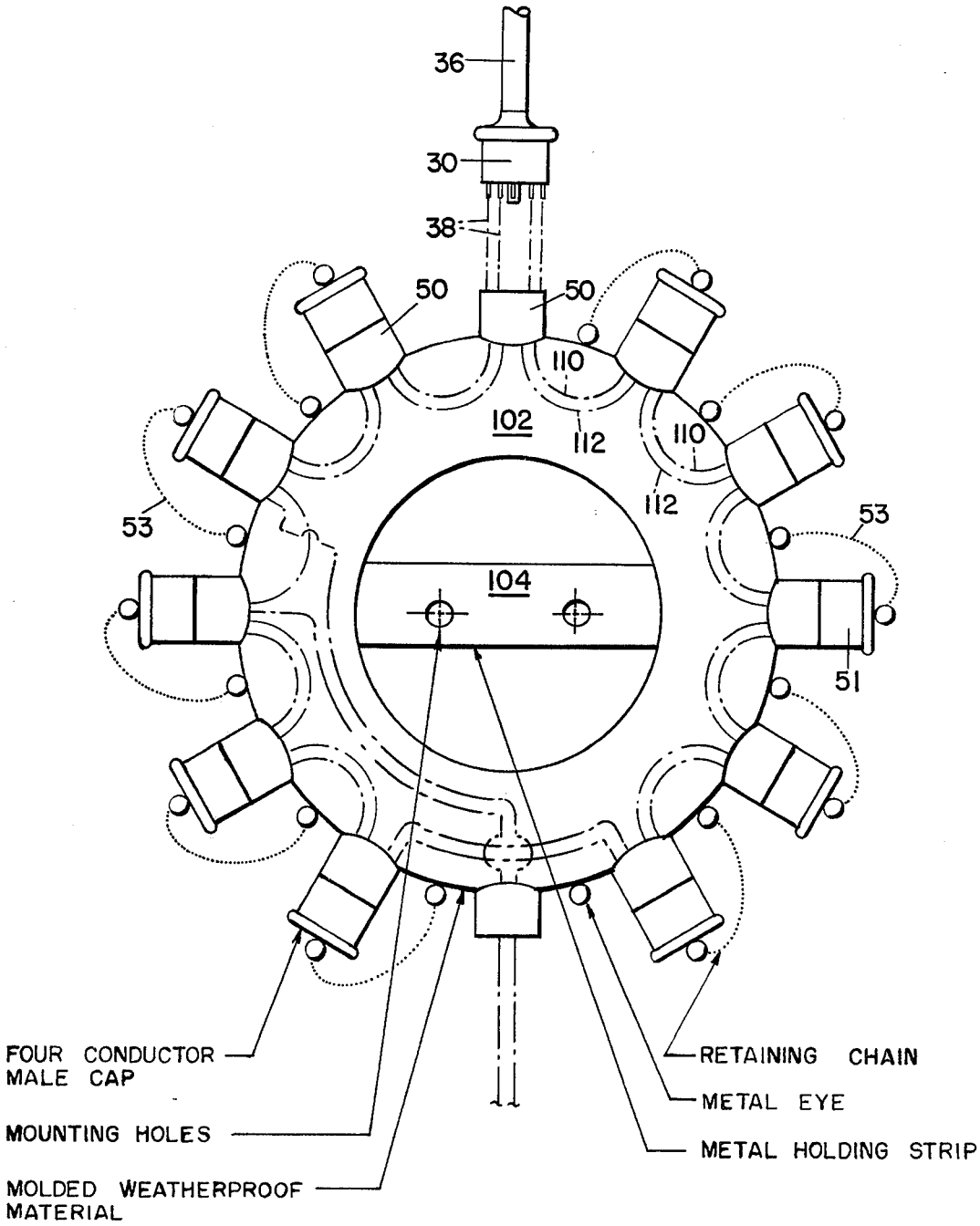

FIG. 3 is a view, in top plan, of a distributor ring of the invention, showing in dash lines, the interconnections between adjacent female conductor plugs, showing one of the accommodating male connecting plugs for a typical connection with one of the female conductor plugs, and further showing one of the female conductor plugs serving as a lead to a suitable switch means and signal and energy source; and FIG. 4 is a view, in top plan, of a series of so-called sleeve loops interconnected with each other and with a common lead to a suitable switch means and signal and energy source.

Figure 1:
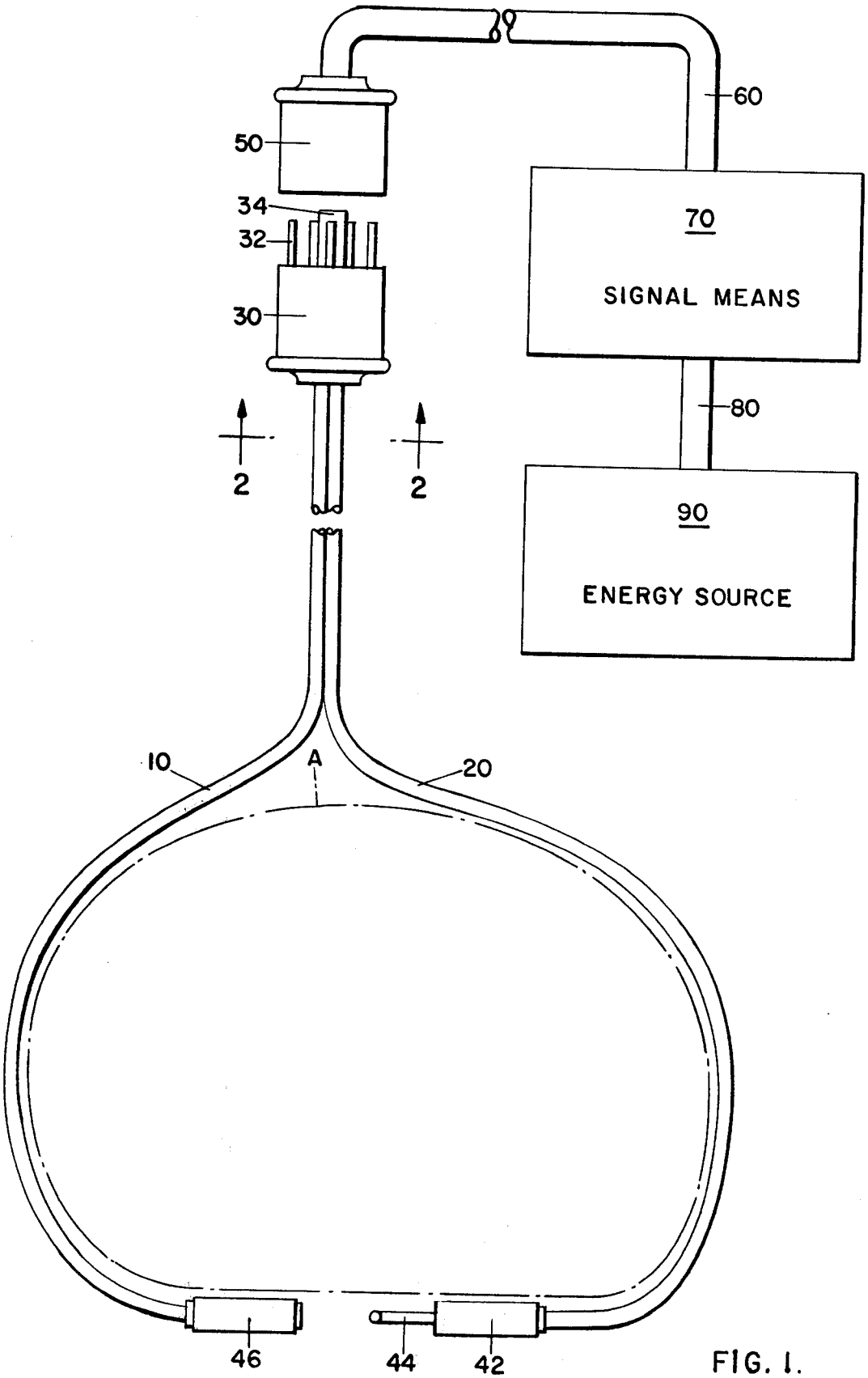
FIG. 1 is a view, in top plan, of a basic security cable unit in the non-looped position.

In FIG. 1, there is shown a security loop system including a cable 10 and a cable 20, which cables are each electrically connected to a connector plug 30.

Connector plug 30 is of male type so as to be provided with a multiplicity of equispaced fingers or projections 32, say eight, even though only four need be alive or electrically-connected in order to serve cables 10 and 20. A locator pin 34 may extend centrally of and outwardly from plug 30, with 8 fingers 32 being circularly-arranged therearound and in spaced relation relative thereto.

Figure 2:
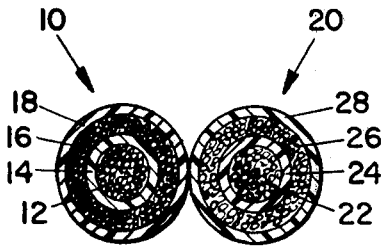
FIG. 2 is an enlarged view, in section, on line 2–2 of FIG. 1.

Cables 10 and 20 are each of the two-conductor type, as will be observed by reference to FIG. 2.

It will be seen that cable 10 is comprised of an innermost core wire 12 made up of a plurality of twisted wires, which, for purposes of exemplification, will be identified as the positive (+) wire, which wire is encapsulated in an extruded insulating jacket 14. An outer braided wire 16 is formed to circumscribe insulator 14 and, for purposes of this exemplification, will be called the negative (−) wire. Wire 16 is encapsulated by an outermost circumscribing insulating jacket 18.

Cable 20 is comprised of an innermost core wire 22 made of twisted wires which for purposes of this exemplification will be identified as the negative (−) wire, which wire is encapsulated in an extruded insulating jacket 24, there being an outer braided wire 26 circumscribing insulator 24, which braided wire will be noted to be the positive (+) wire, with an outermost encapsulating insulating jacket 28 enclosing the positive wire.

Core wires 12 and 22 may each comprise a single wire, if desired, instead of a plurality of wires twisted together with a short lay with the individual wires preferentially each carrying a thin enamel insulation applied thereover, the enamel comprising such as a varnish based on a vinyl acetate resin, polyamide or polyester resin, with the mass of the twisted wires being protected by the aforesaid insulating jacket 14 or 24 respectively.

Jackets or insulators 14 and 24 may be extruded over the respective core wires 12 and 22 and may be formed from conventional jacketing materials such as neoprene, polyethylene or polyvinyl chloride or equivalent.

Outer wires 16 and 26 are preferentially formed of braided wire, the same being covered by the aforesaid outer jacket or insulator 18 and 26 respectively, the jacket being fused thereover so as to render unwanted access to each wire of the braiding exceedingly difficult.

Jackets or insulators 18 and 26 may be similarly extruded over the respective braiding and may be formed from conventional jacketing materials as aforesaid.

Preferentially, the positive conductor wire will be tinned with silver and the negative conductor wire will be of copper.

The opposite ends of cables 10 and 20 are fitted to the female and male components of a phone jack 46 and 42 respectively, male component 42 having the usual projection 44 insertable into the accommodating recess in female component 46 for loop completion.

The other ends of cables 10 and 20 share interconnection with a common male connector 30 having projections 32 and central locator, certain of the projections 32 being connected to the positive wires of cables 10 and 20 and certain thereof being connected to the negative wires of the two cables.

Male connector 30 may be connected to a female connector 50 having suitably-provided recesses for the reception of projections 32 and locator 34, which female connector may be connected by a cable 60 to an alarm device 70 which in turn is connected by a cable 80 to an energy source 90.

The slave loop or lasso arrangement will be understood to be encircled around such as a truck or building or storage area or whatever, same being represented by dash lines designated A in FIG. 1.

Entry into a cable by cutting its outer jacket may interrupt the electrical continuity by severing one or more of the braid wires but, in the event that entry has been successful, the bridging will likely be from the braid wire of one cable to the braid wire of the other cable and in such case the change in electrical continuity and resistance is detected so that an alarm circuit is triggered.

The line incorporating the loop or lasso will be understood to be included as a part of a supervisory circuit at a central station at the facility or area being secured and/or at a station within a police station or detective agency or the like remote therefrom. An decrease in the current in the transmission line such as might be occasioned by a break in the line at the protected area can effect such as a winding of a relay to release its armatures and close a contact governed thereby in an alarm circuit, thus operating an appropriate signalling device (not shown) and indicating an intrusion.

In review, the alarm system is for protection of such as railroad cars on a private siding or a spur track or on railroad property or parked trailers in a trailer park.

The system is an alarm in and of itself or can be an appendage to another closed circuit alarm.

The lasso type of wire arrangement with its two wires, one braided around the other and its insulator, form a complete loop with another two wire arrangement with a four conductor plug molded on the ends of the two wires. The center of the lasso is connected with a set of male and female phone jack connectors having the characteristic that the male end of the phone jack connection may have the positive charge on the core wire and the negative charge on the shield or braided wire while the female end of the connection will have the positive charge on the shield and the negative charge on the core wire. Thus the current will follow the loop of the lasso to the phone jack connection, then coming back via the other half of the lasso on the opposite wire to prevent easy by-pass or shunt.

A thief trying to "shunt" or by-pass the lasso would have to connect the core wire on one side of the lasso to the shield on the other and then connect the other core wire to the remaining shield. However, with the core wires inside the braided wire, same is very difficult. Worse, for the would be thief, if any positive-negative connection is made, the system shorts and goes into an alarm state.

Alternatively, a master loop may be provided as shown in the FIG. 1 exemplification with the current being introduced on the core wire of cable 10 which is connected to say the #2 pin on the 8 pin plug 30, the current following the core (the center conductor) of cable 10 to the phone plug and jack 46, 42 whereat it will be transmitted via a special wiring within the phone jack and plug to the shield of the opposite side of the loop (cable 20) for return via the shield or braid wire of cable 20 to exit via say pin #8 on plug 30.

The current introduced on the shield wire connected to pin #4 would follow the shield to the phone plug and jack and would be transmitted via special wiring to the center conductor (core) of the opposite side of the loop and return via the core will exit via pin #6 on plug 30.

In FIG. 3, reference is made to a system whereby a plurality of such loops or lassos may be tied together within an integrated circuitry, with each loop or lasso serving a particular area which may be distantly of the integrator or distributor ring 102 which may be formed of a suitable molded material and provided with a plurality of four conductor female plugs 50 connected therewith, there being twelve of such four conductor plugs shown for exemplification purposes.

Each such female plug 50 may be provided with a male cap 51 for covering same when the plug is not in use, the caps each being held relative to the ring as by a retaining chain 53 secured to the respective cap and to the ring to prevent loss thereof.

Ring 102 may be provided with an apertured support bar 104 to aid in the mounting of the ring on a wall or more preferably within a secured junction box (not shown) so as to preclude tampering therewith.

A four conductor type male connector plug 30, as shown in FIG. 1, may be electrically jointed with each female conductor plug 50, one such plug 50 in the FIG. 3 exemplification being connected typically to a plug 30 and a four conductor cable 36 for connection to the alarm and energy source (not shown).

The four conductors represented by dash lines 38 each lead to one of the conductors of its respective female plug 50.

Leading from each female plug 50 are a first pair of conductors 110 and 112 which are embedded in the ring 102 and lead therefrom to the next adjacent female plug 50 so that all of the female plugs are thus series connected.

The wiring is preferentially arranged so that the positive charge is introduced into the arrangement so as to flow in a clockwise direction and the negative charge is introduced thereinto so as to flow in a counterclockwise direction.

As aforesaid, in the FIG. 3 exemplification, the molded ring 102 mounts twelve (12) four (4) conductor female plugs, all wired inside the ring in series. Eleven (11) of the plugs have male plugs with them. The male plugs have the wires crossed so as to carry any current that enters on one side of the plug to the other and introduces it into the circle on the wire at an angle to the wire it entered. These wires cross on top of the plug.

The arrangement may be provided with two wires protruding between two of the plugs for use as a tamper switch. The ring, as aforesaid, may be mounted inside a metal box with a solid front hinged on its left side with a tamper switch on its right side to prevent unauthorized opening of the box without inducing an alarm. Such box is not shown.

With reference to FIG. 4, in lieu of the ringlike distributor arrangement just described, a plurality of female connector conductor plugs 250 may be series connected to each other as by connecting wires 231, each wire 231 including the dual wires described in connection with FIG. 1, there being as may female connector plugs so connected as may be desired and practical. To each female plug or certain thereof, as desired, a four conductor male plug 230 and associated cable 236 may be interconnected.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

The above described arrangements are merely illustrative of the principles of the invention and applicant does not intend to limit his invention to the particular embodiments described inasmuch as other embodiments may be devised by one skilled in the art without departing from the spirit and scope of the invention.

I claim:

1. An electrical conductor for the transmission of electrical energy comprising:

(a) a four conductor plug (b) a first conductor including one insulated elongated core member of positively-charged conducting material and an insulated elongated shield member of negatively-charged conducting material, each of the core and shield members being electrically connected at one of their respective ends to a respective one of the conductors of the plug, (c) a second conductor including an insulated elongated core member of negatively-charged conducting material and an insulated elongated shield member of positively-charged conducting material, each of the core and shield members being electrically connected at one of their respective ends to a respective one of the conductors of the plug, (d) a female phone jack connector connected to the first conductor at its free end, (e) a male phone jack connector connected to the second conductor at its free end, with the conductors of the first and second conductors being transposed when the male and female phone jack connectors are interconnected.

2. An alarm system for preventing theft of a protected area or equipment, said system including an electrically continuous closed looped circuit having input terminals through a conductor plug through which the looped circuit is energized, the looped circuit comprising :

(a) a pair of serially-connected legs consisting of (b) a first conductor including one insulated elongated core member of positively charged conducting material and an insulated elongated shield member of negatively charged conducting material, each of the core and shield members being electrically connected at one of their respective ends to a respective one of the conductors of the plug, (c) a second conductor including an insulated elongated core member of negatively charged conducting material and an insulated elongated shield member of positively charged conducting material, each of the core and shield members being electrically connected at one of their respective ends to a respective one of the conductors of the plug, (d) a female phone jack connector connected to the first conductor at its free end, (e) a male phone jack connector connected to the second conductor at its free end, whereby the conductors of the first and second conductors are transposed when the male and female phone jack connectors are interconnected.

3. A security system for indicating intrusion comprised of electric power cables arranged for security purposes comprising:

(a) a four conductor plug (b) a first conductor including one insulated elongated core member of positively charged conducting material and an insulated elongated shield member of negatively charged conducting material, each of the core and shield members being electrically connected at one of their respective ends to a respective one of the conductors of the plug, (c) a second conductor including an insulated elongated core member of negatively charged conducting material and an insulated elongated shield member of positively charged conducting material, each of the core and shield members being electrically connected at one of their respective ends to a respective one of the conductors of the plug, (d) interengageable male and female phone jack connectors connected to each of the first and second conductor at the free ends thereof for the transposing of the conductors of the first and second conductors when the male and female phone jack connectors are interconnected for service as an alarm circuit responsive to intrusion by a thief.

* * * * *